US005416683A

United States Patent [19]

McCarthy

[11] Patent Number: 5,416,683

[45] Date of Patent: May 16, 1995

[54] DROP DISH LIGHTING FIXTURE WITH RECTANGULAR BEAM PATTERN

[75] Inventor: Charles A. McCarthy, Lake in the Hills, Ill.

[73] Assignee: Kenall Manufacturing Co., Gurnee, Ill.

[21] Appl. No.: 249,222

[22] Filed: May 25, 1994

[51] Int. Cl.[6] ..... F21V 5/02

[52] U.S. Cl. ..... 362/328; 362/304; 362/309; 362/332; 362/339; 362/346; 362/349

[58] Field of Search ..... 362/297, 328, 329, 332, 362/339, 304, 305, 308, 309, 346, 349, 408

[56] References Cited

U.S. PATENT DOCUMENTS

| | | | |
|---|---|---|---|
| 1,902,321 | 3/1933 | Crossman | 362/349 |
| 2,739,226 | 3/1956 | Rex | 362/297 |
| 3,638,010 | 1/1972 | Moore | 362/297 |
| 4,310,876 | 1/1982 | Small, Jr. et al. | 362/346 |
| 4,633,377 | 12/1986 | Mackiewicz | 362/309 |
| 5,251,116 | 10/1993 | Wijbenga et al. | 362/304 |

FOREIGN PATENT DOCUMENTS

| | | | |
|---|---|---|---|
| 0538141 | 11/1931 | Germany | 362/304 |
| 0214727 | 8/1941 | Switzerland | 362/297 |

*Primary Examiner*—Ira S. Lazarus
*Assistant Examiner*—Alan B. Cariaso
*Attorney, Agent, or Firm*—Michael G. Berkman

[57] ABSTRACT

A lighting fixture for overhead mounting to produce a generally-rectangular, outwardly and downwardly directed light illumination over a broad areal expanse. The fixture includes a pair of back-to-back arranged reflectors depending from a supporting overhead housing and defining arcuate, generally-parabolic sections flaring outwardly horizontally of one another from opposite sides of a lamp of the fixture. A refractor of polymeric organic composition overlying and protectively capping the lamp and the reflectors diffuses, distributes and directs illumination from the lamp, from the parabolic reflectors and from a reflector plate located above the reflectors to provide an expansive, essentially rectangular-beam light pattern of uniform illumination. Physically faceted upper sections constituting flattened areas of the parabolic reflectors enhance the distribution of light to ensure more even illumination patterns and eliminate "dark" zones.

19 Claims, 2 Drawing Sheets

DROP DISH LIGHTING FIXTURE WITH RECTANGULAR BEAM PATTERN

FIELD AND BACKGROUND OF THE INVENTION

The present invention relates to a light-distributing electrical fixture. More particularly, the invention is directed to a reflector/refractor system for providing high vertical and ceiling illumination with exceptional uniformity and illuminance over an expansive rectangular pattern.

Lighting fixtures for providing controlled illuminated patterns are known in the art. Illuminating fixtures generating square beam patterns are described in Mackiewicz U.S. Pat. No. 4,633,377. The same patent also teaches the use of light-diffusing structural devices of plastics compositions. The entire disclosure of that patent is hereby specifically incorporated herein by reference to the extent it is not inconsistent herewith.

Lighting apparatus of the general type described in the present invention finds special utility in parking structures.

The fixture of the present invention belongs to the non-cutoff liminaire category. In one embodiment the fixture generates a rectangular, bisymmetrical, lighting pattern that provides uniformity for a typical 60'×20' parking bay with a single row of fixtures down the center of the drive lane.

The design provides a high vertical and ceiling illumination with exceptional uniformity. It is the aim of the lighting system of the invention to provide a full measure of security and safety in an energy-efficient manner.

SUMMARY OF THE INVENTION

The present invention provides a lighting fixture for overhead mounting to produce a generally-rectangular, bisymmetrical light distribution pattern of relatively-uniform high vertical and ceiling illumination.

In a preferred embodiment, the fixture includes a housing, a lamp supported in the housing and projecting parabolic reflector sections, a reflector plate, and a refractor. All elements function in cooperation to direct, distribute and diffuse the lamp-derived illumination to achieve an expansive, essentially-rectangular-beam light pattern of uniform illumination.

It is an important feature of the invention that there is provided a pair of arcuate, generally parabolic reflector sections attached to and depending from the housing of the fixture, and being arranged in a back-to-back relationship to direct light outwardly in opposed, lateral, in-line beams.

A related feature of the invention is that the opposed parabolic reflector sections are mounted at either of opposite sides of a lamp supported therebetween and in a zone adjacent the focal points of the parabolic sections.

A characteristic of the lighting fixture of the invention is that it produces an expansive, essentially rectangular beam light pattern of uniform illumination.

In accordance with the practice of the present invention the fixture is secured to depend from an overhead structure to direct illumination in opposed lateral directions and with spatial zones beneath the fixture.

A feature of the invention is that the parabolic reflector sections are formed with cut-away portions at lower sectors thereof for enhancing delivery from the lamp of illuminating light to subtended areal zones more directly below the lighting fixture.

Yet another related novel and distinguishing feature of the parabolic reflector sections of the lighting fixture of the invention is that the reflectors are mechanically deformed at upward and laterally outward zones thereof to define restricted flattened areas for developing more even illumination distribution patterns.

An important feature of the invention is that it includes a reflector plate attached to and bridging a lower lateral expanse of the housing of the fixture for directing light impinging thereon downwardly from the fixture to illuminate zonal areas therebelow.

The present invention is characterized in that the parabolic reflector sections include radially inwardly directed marginal end portions which invade a zone immediately embracing the lamp, the end portions being attached to one another and and to the housing of the fixture to stabilize the reflector sections.

In addition to the parabolic reflecting sections and the reflector plate, the lighting fixture of the invention includes a refractor constituting an inverted, truncated pyramid opening upwardly, encasing the parabolic sections and the lamp, and fastened to the housing to depend therefrom.

It is a feature of the refractor of the lighting fixture of the invention that it is formed of prismatically contoured side walls and an integrally formed rectangular base surmounted with a crown-like cap.

In a preferred embodiment of the invention the refractory diffuser is of a unitary construction and is composed of an injection molded plastics composition, for example polycarbonate or acrylic.

A feature of the invention is that the housing is fabricated of heat-dissipative metal, for example of die-cast aluminum or aluminum alloys.

A practical feature of the invention is the refractor is fabricated of an extraordinarily high impact strength plastics material such as polycarbonate to resist and withstand substantial abuse.

Yet another feature of the refractor used in the fixture of the invention is that it has trapezoidal sides formed with a fluted light-disbursing pattern, preferably on an under surface thereof.

Still another feature of the refractor diffuser used as a component of the present invention is that it is integrally formed with a rim-like flange assembly to facilitate attaching the diffuser to the surmounting housing of the fixture.

It is an important feature of the invention that it includes a high intensity illuminating lamp supported to extend normally of the reflectors and in a common focal zone thereof.

Further objects, features and advantages of the invention will become apparent from the following detailed description read in conjunction with the accompanying drawings. The features of the invention believed to be novel will be more particularly pointed out in the appended claims.

DETAILED DESCRIPTION OF ILLUSTRATED EMBODIMENT

The aims and objects of the present invention are achieved, in accordance with the practice of the invention, by providing a drop dish lighting fixture for overhead mounting to generate a generally rectangular light distribution pattern of uniform high illumination.

The light generating and distributing components of the fixture include a unique combination of back-to-back, generally parabolic reflectors projecting from either side of a high intensity lamp mounted at a focal point between and common to the reflectors. The reflectors themselves are specially cut away and are formed with flattened sections to enhance illumination in desired zonal areas and to generate more even illumination over an extended, generally rectangular expanse.

Figure 1:
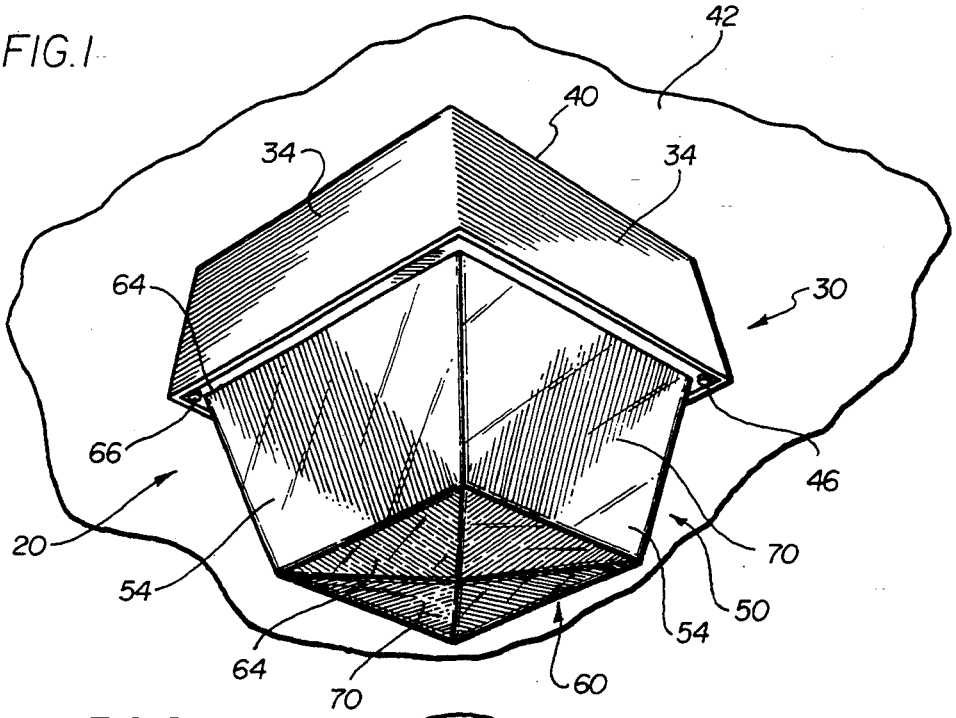
FIG. 1 is a perspective view of an overhead-mounted lighting fixture according to the invention, as viewed from below.
Figure 2:
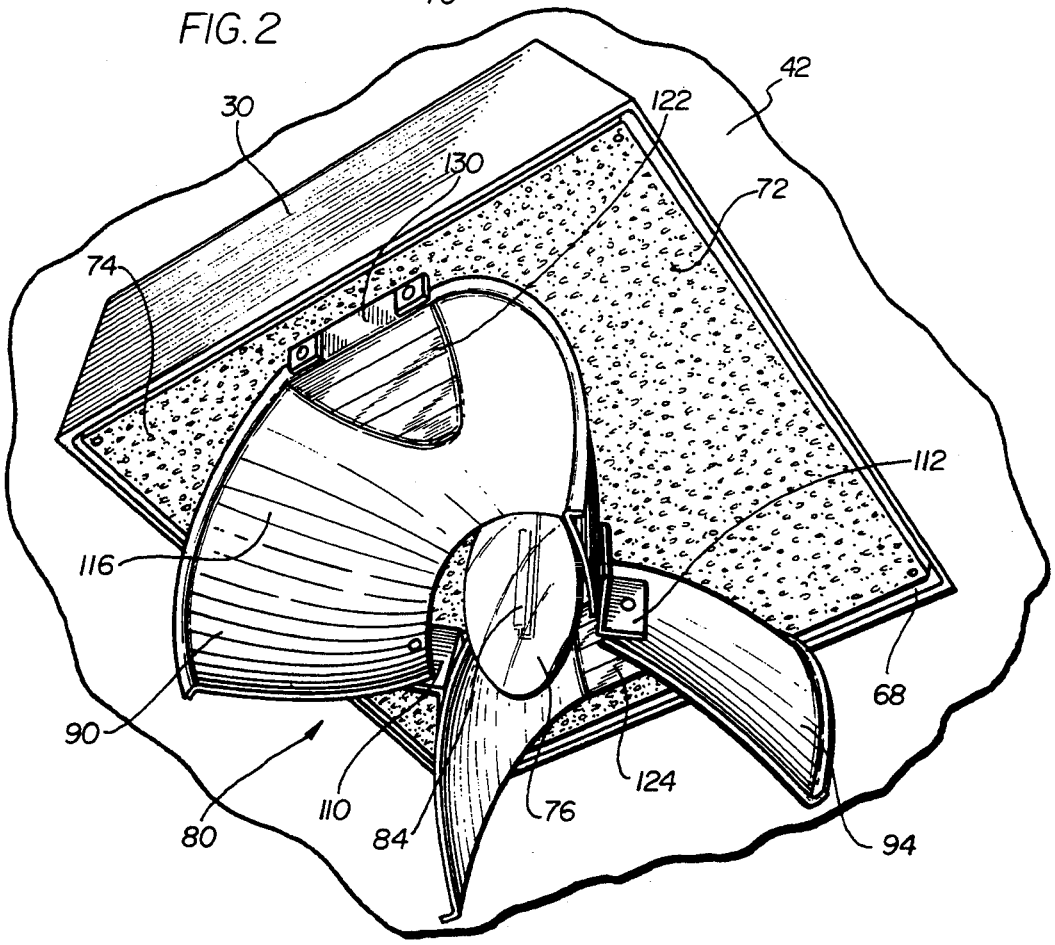
FIG. 2 is an enlarged view of the fixture of FIG. 1 with the refractor removed to show the illuminating lamp and the symmetrically-disposed, modified and cut-away parabolic reflectors at either side of the lamp.
Figure 3:
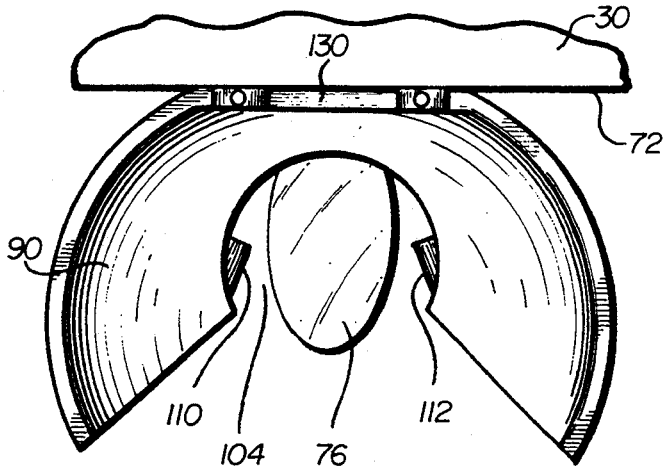
FIG. 3 is a fragmentary end view showing one of the two parabolic reflectors, and the illuminating lamp.
Figure 4:
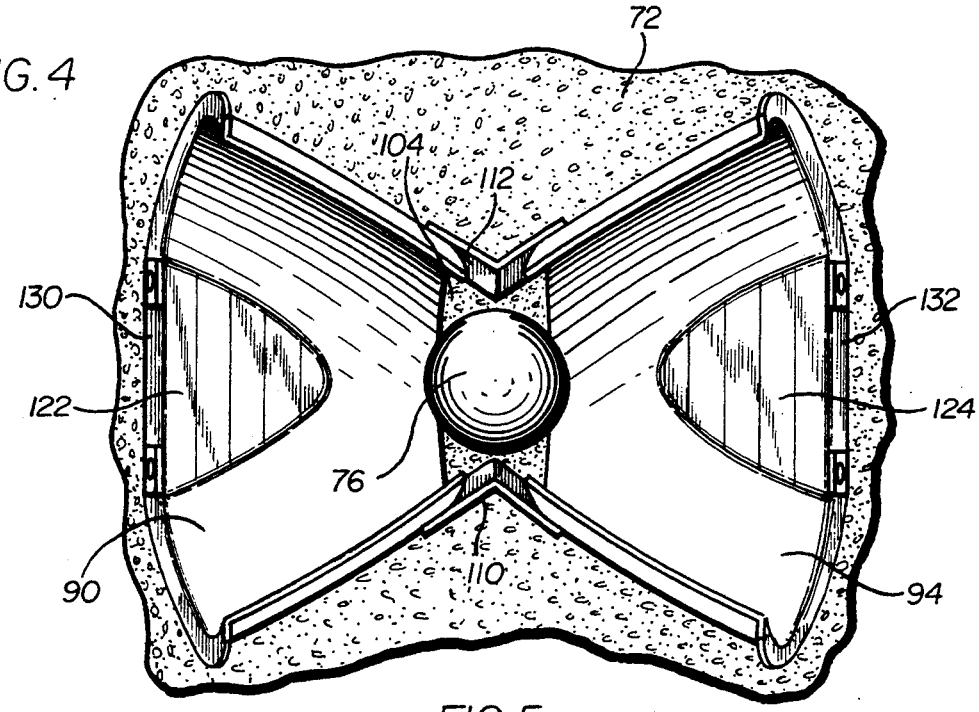
FIG. 4 is a fragmentary view looking up into the fixture, with the refractor removed, and showing the dual contour-modified parabolic reflectors of the fixture.
Figure 5:
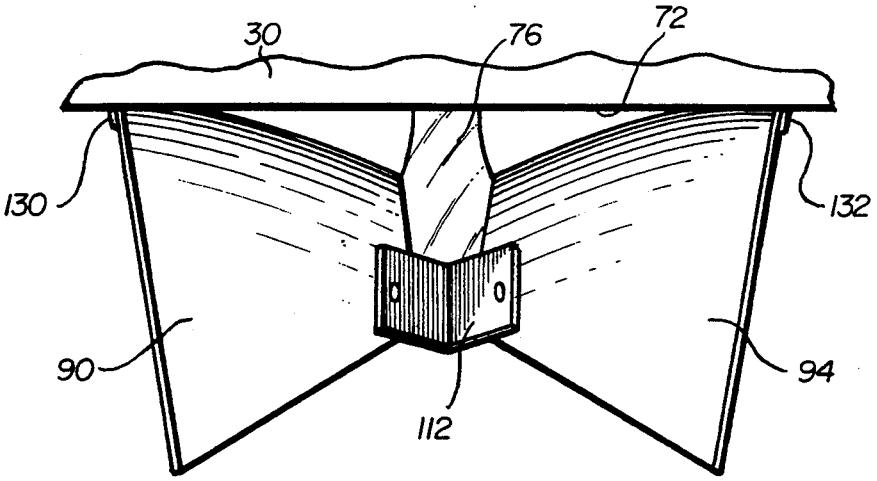
FIG. 5 is a fragmentary view showing a side elevational view of the parabolic reflectors and the illuminating lamp of the fixture.

Referring now to the drawings, and more particularly to FIGS. 1 and 2, there is shown one preferred embodiment of the invention provided for illustrative purposes and not to be construed in any limiting sense. The fixture 20 includes, in the embodiment illustrated, a housing 30 having four perimetric walls 34, and a top 36. The housing 30 is generally rectangular in transverse cross section and is surmounted by a top wall 40 fastened to an overhead structure or ceiling 42. In a preferred embodiment of the invention the housing 30 is of cast aluminum and is finished with a highly reflective, smooth, glossy, non-corrosive, durable coating of an organic polymeric composition. The coating itself is 92% reflective.

A horizontally-extending, inwardly-directed flange 46 circumscribes the housing 30 at its base. Subtended from the housing 30 and secured thereto, at the flange 46 is a downwardly projecting refractor 50 serving as a light-distributing diffuser. In the example shown, the refractor is in the configuration of an inverted truncated pyramid terminating at a lower extremity of its four sidewalls 54 in a depending cap or crown 60. The latter, consisting of four triangular sections 64, is integrally formed with the sidewalls 54 of the refractor 50. In other embodiments of the invention the crown 60 of the refractor may be a flat sheet. An upper rim 64 integral with and surmounting the refractor 50 projects outwardly of the refractor 50 and is secured to the housing 30 at the flange 46. Fastener screws 66 or other suitable attachment devices may be used. A gasket 68 is interposed between the housing 30 and the refractor 50 as a protective seal.

The sidewalls 54 of the diffuser or refractor 50 are preferably formed with a ribbed or fluted, molded or otherwise produced light-dispersing pattern 70. Similar surface modifications are formed on the depending crown 60 of the diffuser 50.

In FIG. 2 the refractor 50 of the fixture 20 has been removed to show the illumination producing and distributing elements of the assembly. A reflector plate 72 is fastened to and covers the entire lower areal expanse of the housing 30. In a preferred embodiment of the invention the plate 72 is a highly-polished, hydroformed aluminum sheet with specular anodized high-gloss coating 74 ensuring maximum reflectivity of light directed against or impinging thereon.

A light-generating lamp 76 and a reflecting assembly 80 are attached to and depend from the housing 30, projecting downwardly from the reflector plate 72. In a preferred embodiment of the invention the lamp 76 is a high intensity discharge type with an arc tube 84. High pressure sodium (for yellow light) or metal halides (for white light) may be used in lamps generating from about 70 to about 175 watts of power. Suitable transformers, ignitors, capacitors and other electrical control elements (not shown) are used. A system exhibiting an efficiency of 85% or higher is achieved, some absorption occurring in the plastics refractor 50. The latter is preferrably composed of a polycarbonate such as Lexan. The zone of illumination is, for example, an area of 20 feet by 60 feet, with the fixture mounted 8 or 9 feet above the floor.

In accordance with the practice of the invention, the enhanced distribution of light, including the generation of a generally rectangular pattern of exceedingly uniform high illumination, is achieved through the use of a novel configuration of the reflector assembly 80 and its spatial disposition with reference to the illumination source or lamp 76. The physical structures and the arrangement of elements are described with reference to FIGS. 2 through 5.

The reflector assembly 80 includes a pair of arcuate, generally parabolic sections 90 and 94 extending laterally from and flaring outwardly from the illuminating lamp 76. The parabolic sections 90 and 94 are cut away 100 in respective focal zones thereof proximate the lamp 76, the latter extending downwardly of and generally normally from the reflector plate 72 to invade and occupy a focal zone area 104 which is common to the opposed reflectors 90 and 94. Generally V-shaped or wing-like brackets 110 and 112 interconnect and stabilize the parabolic reflectors 90 and 94 in the focal zone area 104.

As shown, the parabolic reflector sections are cut away to provide lower sectors which are open 116 and 118 so that light may be directed in areas more generally below the fixture 20. In opposed upper sectors, at outer peripheries thereof, the reflectors 90 and 94 are arced, multi-faceted sections 122 and 124 for controlling light reflection and to obviate development of illumination zones which may otherwise be objectionally somewhat dark. Flange-like fasteners 130 and 132 at the peripheral margins of the faceted, arcuate sections 122 and 124 secure the reflectors 90 and 94 to the reflector plate 72 to stabilize the parabolic sections 90 and 94.

What is claimed is:

1. A lighting fixture for overhead mounting to produce therebeneath a generally-rectangular, bisymmetrical light distribution pattern of relatively uniform high vertical and ceiling illumination, said fixture comprising a housing, and means for securing said housing to an overhead structure, in a functional mode, lamp means for providing a source of electrical illumination, and means for fastening said lamp means to said housing, reflector means, and means for fastening said reflector means to depend from said housing at each of a pair of opposed sides of said lamp means for reflecting lamp-derived light of said fixture bisymmetrically in opposed lateral directions, and into spatial zones beneath said fixture, said reflector means including arcuate, generally parabolic sections extending laterally from and flaring outwardly of said lamp means for directing opposed radiating beams of light generally outwardly from said fixture and in a direction away from a locus of attachment of said fixture to a supporting structure, and for facilitating directing light downwardly from said fixture, and refractor means for diffusing, distributing, and directing illumination from said lamp means and from said reflector means for achieving an expansive, essentially-rectangular beam light pattern of uniform illumination.

2. The lighting fixture as set forth in claim 1 wherein each of said reflector means includes a deformed light-reflecting area at an upper and laterally outward zone thereof to define a flattened section, light-directing means for enhancing the distribution of light and for providing a more even illumination distribution pattern.

3. The lighting fixture as set forth in claim 1 and further comprising reflector plate means bridging a lower lateral expanse of said housing for directing impinging light downwardly from said fixture.

4. The lighting fixture as set forth in claim 3 and further comprising fastener means for securing said reflector sections to said reflector plate means.

5. The lighting fixture as set forth in claim 1 wherein said reflector sections include radially inwardly disposed marginal end portions which invade a zone immediately embracing said lamp means, and further comprising fastener means for attaching said end portions to one another mechanically to stabilize said reflector sections.

6. The lighting fixture as set forth in claim 1 wherein said means for fastening said reflector means to depend from said housing include reflector-means-carried flange means for fastening said reflector means to said reflector plate means at outwardly displaced marginal end zones of respective said reflector means.

7. The lighting fixture as set forth in claim 1 including socket means for supporting said lamp means at nominally a focus of each of said parabolic reflecting sections.

8. The lighting fixture as set forth in claim 1 wherein said reflector means includes a reflecting surface having a specular finish.

9. The lighting fixture as set forth in claim 3 wherein said reflector plate means comprises an aluminum plate with a semi-specular, diffuse surface pattern.

10. The lighting fixture as set forth in claim 1 wherein said housing comprises a cast aluminum structure having a highly reflective, smooth, glossy, non-corrosive, durable coating of an organic polymeric composition.

11. The lighting fixture as set forth in claim 10 wherein said coating is 92% reflective.

12. The lighting fixture as set forth in claim 1 and further comprising gasket means interposed between said refractor means and said housing for establishing a seal therebetween to obviate entry of foreign matter interiorly of said refractor means and said housing.

13. The lighting fixture as set forth in claim 1 wherein said lamp means is a high intensity discharge lamp.

14. The lighting fixture as set forth in claim 1 wherein said refractor means comprises an inverted, truncated pyramid of unitary plastics construction and including prismatically contoured side walls for light diffusion, a rectangular base and a light-diffusing crown-like cap surmounting said sidewalls.

15. The lighting fixture as set forth in claim 14 wherein said refractor means comprises an injection molded, high-temperature acrylic structure.

16. The lighting fixture as set forth in claim 14 wherein said refractor means is comprised of injection molded clear polycarbonate.

17. The lighting fixture as set forth in claim 1 wherein said parabolic sections of said reflector means are formed with cut-away portions at lower sectors thereof for enhancing delivery from said lamp means of illuminating light to areal zones more directly below said lighting fixture.

18. The lighting fixture as set forth in claim 1 wherein said reflector means delineate an essentially common focal point and wherein said lamp means is secured between said reflector means in a zone of said common focal point.

19. The lighting fixture as set forth in claim 1 wherein said reflector means is formed with faceted areal sectors constituting means for obviating darkened zones in a pattern of illumination developed by said fixture.

* * * * *